US005328189A

United States Patent [19]

Malek

[11] Patent Number: 5,328,189

[45] Date of Patent: * Jul. 12, 1994

[54] METHOD AND APPARATUS OF PLAYING A NEW CASINO GAME

[76] Inventor: Mehrdad M. Malek, 1306 Daviswood Dr., McLean, Va. 22102

[ * ] Notice: The portion of the term of this patent subsequent to Nov. 30, 2010 has been disclaimed.

[21] Appl. No.: 80,871

[22] Filed: Jun. 24, 1993

Related U.S. Application Data

[63] Continuation-in-part of Ser. No. 16,308, Feb. 11, 1993, Pat. No. 5,265,882.

[51] Int. Cl.[5] ..... A63F 1/00

[52] U.S. Cl. ..... 273/292; 273/274; 273/309

[58] Field of Search ..... 273/292, 294, 309

[56] References Cited

U.S. PATENT DOCUMENTS 5,265,882 11/1993 Malek ..... 273/292

OTHER PUBLICATIONS

Scarnes Encyclopedia of Games by John Scarne, Harper & Row Publishers, pp. 39, 1973.

*Primary Examiner*—Benjamin H. Layno

*Attorney, Agent, or Firm*—Parkhurst, Wendel & Rossi

[57] ABSTRACT

A method and apparatus for playing a mixture of Twenty-One and Baccarat wherein a player can simultaneously play both games against the dealer and other players. The players and the dealer have the option to place an additional bet against the casino and receive a fifth card which is appropriately summed with both sets of cards for Twenty-One and Baccarat.

18 Claims, 3 Drawing Sheets

METHOD AND APPARATUS OF PLAYING A NEW CASINO GAME

This application is a continuation-in-part of Ser. No. 08/016,308, filed Feb. 11, 1993, now U.S. Pat. No. 5,265,882, issued Nov. 30, 1993.

This invention relates to a card game, in particular to a card game suitable for use in casinos, and to a specifically designed table for playing the game. More specifically, this invention relates to a method of and apparatus for playing a mixture of Twenty-One and Baccarat wherein a player can simultaneously play against a dealer and other players.

BACKGROUND OF THE INVENTION

There are many card games which can be used for gambling purposes, but often these games are played only against the casino/bank. Also, each card game is usually played individually and it is rare to play more than one type of gambling game against the dealer at any given time. U.S. Pat. No. 5,154,429 discloses a method of playing multiple action blackjack, but the play is limited to each player versus the dealer, who represents the casino or bank, and the play is limited solely to blackjack. Other casino games are disclosed in U.S. Pat. Nos. 4,651,997; 4,659,087; 4,836,553; 5,013,049; 5,098,107; 5,141,234; and 5,174,579.

There is also another casino game known as Pai-Gow Poker (also known as Asian poker). In this game each player plays against the bank (Casino) and each receives seven cards after placing their bets against the bank. Then each player picks up his cards and sets them in two hands consisting of a two card set (one set having five cards, the other set having two cards) according to the rules of Draw Poker. Both hands must be winners against the Casino in order to win the game against the Casino. If one hand wins and the other hand loses it will be a push and the bet will stay for the next round of play.

However, heretofore a card game has not been proposed wherein the player challenges not only the dealer but other players, and also the player can play Twenty-One and Baccarat simultaneously, thus significantly increasing the odds of winning against the bank.

SUMMARY OF THE INVENTION

It is an object of the present invention to provide a gambling game which is a mixture of Twenty-One, and Baccarat, wherein the player can simultaneously play both games not only against the dealer, but against other players.

The present invention relates to a method of playing a mixture of Twenty-One and Baccarat wherein a player simultaneously plays against a dealer and other players, comprising:

providing a playing station for each player, said playing station comprising:

(i) a card playing area having a first horizontal row of two boxes, a second horizontal row of two boxes, and a third box positioned to one side of the first and second horizontal rows of boxes;

(ii) a casino betting area positioned to one side of the third box;

(iii) an extra card betting area positioned adjacent the casino betting area; and (iv) a player betting area positioned to the other side of the card playing area and having two positions corresponding to the first and second horizontal rows of boxes in the card playing area;

each player making a first bet in the casino betting area of their playing station;

the dealer dealing a first card face-up to each player and one card face-down to the dealer;

at least one player making a second bet in at least one of the two positions in the player betting area of his playing station;

the dealer dealing three additional cards face-down to each player and the dealer;

each player assembling two cards dealt from the dealer face down in each of the first and second horizontal rows of boxes;

the dealer assembling his four dealt cards in a dealer playing station face down in a manner corresponding to each player;

at least one player making a third bet in the extra card betting area of his playing station;

the dealer dealing a fifth card to and placing that card face down in the third box of the playing station of said at least one player making a third bet;

the dealer comparing the cards assembled in each row of boxes in his playing area to cards assembled in corresponding rows of boxes in each player playing station, wherein the card in said third box is appropriately summed with the cards in each of the first and second rows of boxes, and collecting or paying said first and third bets in the casino and extra card betting areas of each playing station; and the dealer comparing cards assembled in each row of boxes in each player playing station, wherein the card in said third box is appropriately summed with the cards in each of the first and second rows of boxes, and settling said second bets between players in each player betting area of each playing station.

In the present invention the player has the option of placing a third bet against the casino in order to receive a fifth card from the dealer, which card is appropriately summed with the player's Twenty-One and Baccarat hands to hopefully improve one or both of those hands. "Appropriately summed" as used herein means that the cards are added in line with traditional Twenty-One and Baccarat rules, with any modifications as discussed later herein.

The present invention also relates to an apparatus for playing a mixture of Twenty-One and Baccarat wherein a player simultaneously plays against a dealer and other players, said apparatus comprising:

a table having an upper playing surface;

a dealer playing station at a first position on said playing surface, said dealer playing station comprising two horizontal rows of two boxes and a third box positioned to one side of the two rows of boxes; and a plurality of player playing stations at spaced positions on the playing surface and opposed to said dealer playing station, each of said player playing stations comprising two horizontal rows of two boxes arranged in the same manner as in the dealer playing station, a third box positioned to one side of the two horizontal rows of boxes, a casino betting area positioned to one side of the third box, an extra card betting area positioned adjacent the casino betting area, and a player betting area positioned to the other side of the horizontal rows of boxes and having two positions corresponding to the two horizontal rows of boxes.

The game according to the present invention can be referred to as BAC/ONE for convenience.

These and other objects of the present invention will be better understood after reviewing the following detailed description taken in conjunction with the attached drawings.

DETAILED DESCRIPTION OF THE PREFERRED EMBODIMENTS

Figure 1:
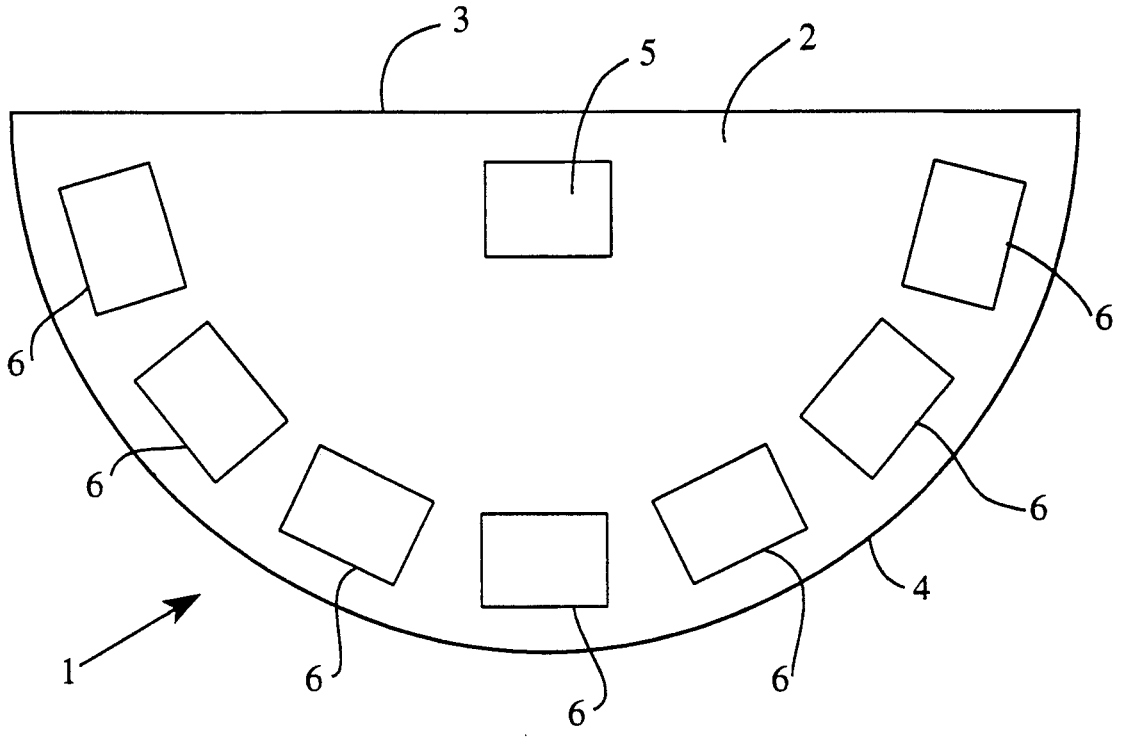
FIG. 1 shows a preferred layout of the apparatus of the present invention which is used in connection with the method of the present invention.

FIG. 1 shows a preferred set-up for the apparatus of the present invention. More specifically FIG. 1 shows a preferred embodiment of the apparatus of the present invention, which includes a table 1 having an upper playing surface 2 formed substantially in the shape of a semicircle. The surface 2 has a substantially linear side 3 along the diameter of the semicircle and a curved side 4 along the circumference of the semicircle. A dealer playing station 5 is arranged substantially midway along the diameter of the semicircular playing surface. Seven player playing stations 6 are arranged along the circumference of the semicircular playing surface and are spaced an equal distance apart.

Figure 1A:
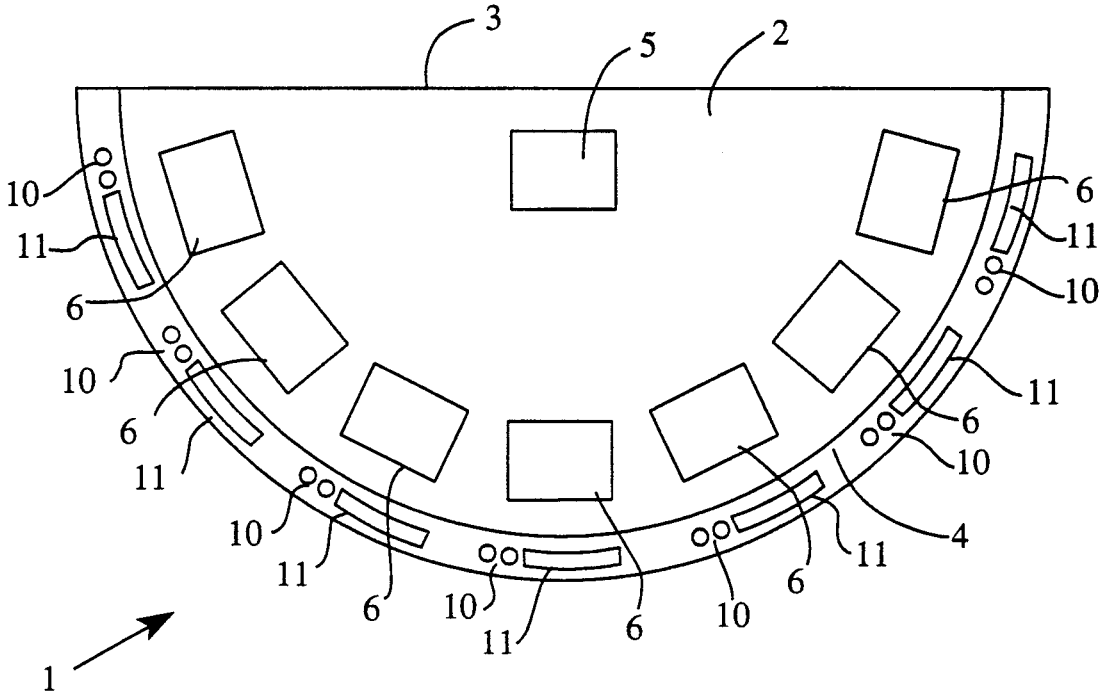
FIG. 1A shows a modified version of the apparatus of FIG. 1.

FIG. 1A shows a modified version of the apparatus of FIG. 1, which includes openings 10 through the table 1 and individual chip trays 11 for each player. The openings can be used to hold drinks, ash trays, and the like.

Figure 2:
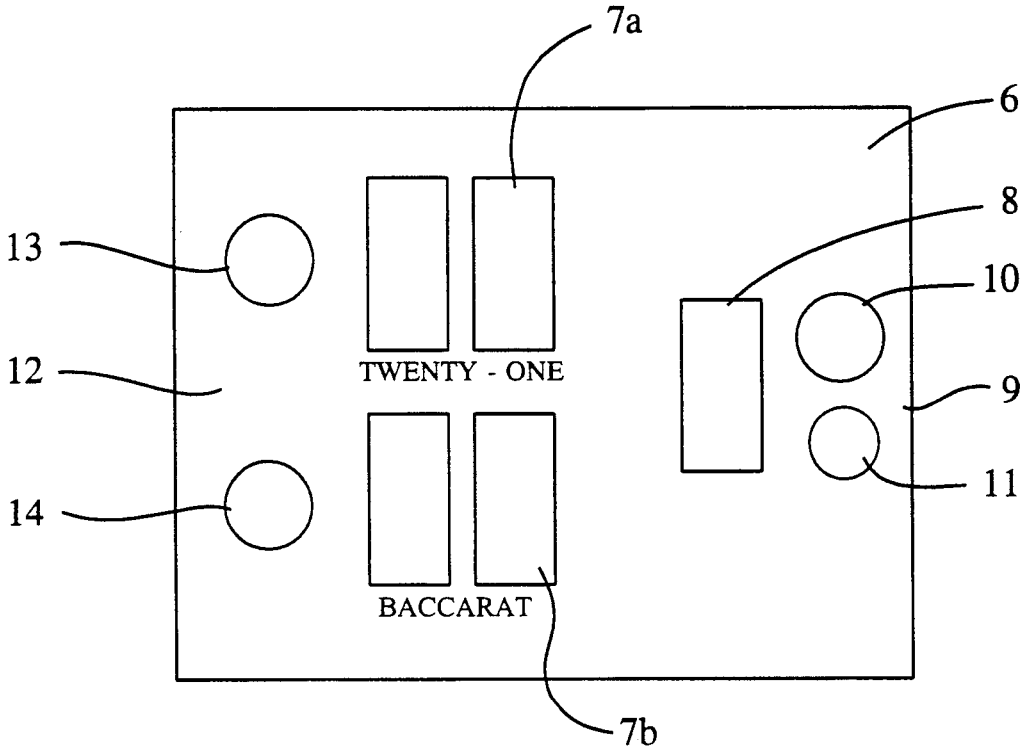
FIG. 2 shows an enlarged view of an individual player playing station in accordance with the apparatus and method of the present invention.

FIG. 2 shows an enlarged view of an individual player playing station 6 of FIG. 1. Each player playing t station 6 includes two horizontal rows of boxes 7*a* and 7*b*, both preferably including two boxes. Although these rows can be arranged in any order, preferably the first row of boxes is used to play Twenty-One and the second row of boxes is used to play Baccarat. This set-up is so labeled in FIG. 2. Arranged to one side of the two horizontal rows of boxes is a third box 8 for receiving an extra card dealt from the dealer. Arranged to one side of the third box is a casino or bank betting area 9 which has two positions 10 and 11. It is in box 10 of the bank betting area where the player places a bet against the casino to begin the game against the dealer. It is in box 11 of the bank betting area where the player places an additional bet against the casino to receive the optional fifth card. On the other side of the two rows of boxes is the player betting area 12, including two betting boxes 13 and 14, wherein the player can bet against other players as if betting against the casino. The dealer playing station 5 includes the same horizontal rows of boxes provided in each player playing station, but the bank and player betting areas can be omitted from the dealer playing station.

The playing table 1 can include any number of player playing stations 6, but preferably, this number is limited to seven to facilitate monitoring by the dealer.

The present invention is carried out in the following manner. The dealer begins with at least two standard decks of fifty-two cards comprising a total of at least 104 cards which are placed in a shoe, after shuffling, for distribution. This is very similar to conventional blackjack techniques, although the casino can add decks of cards as desired. For the purposes of explaining the game, we will assume that seven player positions are used and are all occupied. The bank is always held by the casino, as is a standard practice in any commercial establishment. Conventional shuffling and cutting of the cards is carried out by the dealer before commencement of the game.

Prior to any cards being dealt, each player places a first bet against the dealer in the casino box 10 of the bank betting area 9 of his playing station. After all bets are made against the bank, the dealer then proceeds to deal one card face-up to each player, and one card face-down to himself. After the players assess their card against the card of each other player, the highest ranking card on the table has the option to place an additional bet against all other players in the player betting area 12 of his playing station. The player can bet against other players in both of the games in which he has bet against the casino. Each player's second bet can be at least 50%, but not more than 100% of his bet against the dealer. If the player holding the highest ranking card does not wish to bet against other players, this optional betting privilege then passes to the second highest-ranking card holder on the table, and if he passes, to the third highest-ranking card holder on the table. If all three of these players pass, then no optional, inter-player bets can be placed. If one of these three players makes a second bet, which must be made in both components of the game, then it is up to other players to decide whether to match that bet. The other players can not raise. Any player who passed the second bet can match a second bet placed by a lower ranking cardholder. If no other players match that bet, then the betting player removes his bet from his player betting area 12. If more than one player holds the highest-ranking card on the table (e.g., three players are dealt an ace), then the optional betting against other players commences clockwise from the dealer around the table among the players.

Assume, however, that the player holding the highest-ranking card dealt by the dealer decides to place a second bet in the player betting area 12 of his station. That player must then place a bet in the player betting area 12 of his station corresponding to both games in which he has bet against the bank. That is, since the player must play both components (i.e., Twenty-One and Baccarat) of the game against the dealer, if that player decides to make a second bet against another player, he must bet both components of the game against the other player. After the player holding the highest-ranking card on the table places his bet, the remaining players can place second bets in their respective player betting areas 12 to match the second bets of the highest ranking card holder.

After all second bets are placed by the players, the dealer then deals single cards to each of the players and himself in a traditional clockwise fashion. The number of cards which each player receives from the dealer is at first a total of four. Although the first card dealt to each player is face-up, each card thereafter is dealt face-down. All cards dealt to the dealer are face-down.

The players gather the four dealt cards in their hands and in a timely manner, set two different hands in each of the respective two horizontal rows of boxes 7*a* and 7*b* in their playing station 6. More specifically, each player will take his two best cards for Twenty-One and place those cards face-down in the first row 7*a* of his playing station. Each player will then take his remaining cards and place those cards face-down in the second row 7*b* of his playing station 6. The players hereafter can not touch their cards. The dealer also arranges his cards in this manner face-down. The game requires that the player evaluate his four cards and come up with the best two hands for each of Twenty-One and Baccarat, depending upon bets placed against the bank as well as bets placed against other players.

After each player has assembled all cards face-down in his playing station 6, the dealer then will ask each player if he wants one additional card. If so, then the player must wager one-half his first bet against the dealer to receive a fifth card. The one-half wager (third bet) is placed in box 11 of the bank betting area 9 and the dealer places the fifth card face down (perhaps after flashing the card to the player) in the extra card box 8.

After all player decisions have been made about buying a fifth card, the dealer then determines whether he should take a fifth card. The dealer cannot draw an additional card if the Twenty-One component of his game is showing the value of 17 or more, regardless of what is showing in the Baccarat component. If the dealer's Twenty-One component shows a value of 16 or less, then the dealer can take the fifth card provided the Baccarat component is not a total of 9.

The dealer then, perhaps with the help of an assistant, turns over each card in its respective box in each player station 6. The dealer then turns over each one of his cards as previously positioned by him in the two rows 7*a* and 7*b* (and optionally box 8) in his playing station 5.

Now the dealer compares each one of his hands against each corresponding hand of each player. In the first row 7*a* of boxes where Twenty-One is played, the dealer compares his cards (plus any fifth card in his extra card box 8) to the cards (plus any fifth card in the extra card box 8) in each corresponding row of each player station. The person whose two cards sum closest to or equal to 21 wins.

Then the dealer compares the cards in his second row 7*b* (plus any fifth card in his extra card box 8) against the corresponding row of cards in each player station. The person whose cards sum closest to nine wins.

The rules of Twenty-One apply in the Twenty-One row (i.e., closest to 21 wins) except there will be no blackjack for the players or the dealer. Traditional Baccarat rules apply in the Baccarat row, in that the player or dealer having two cards totaling closest to nine wins and nine is the winner over all other values. That is, aces are eleven in Twenty-One and one in Baccarat; face cards and tens are counted as ten in Twenty-One and zero in Baccarat; all other cards are counted at face value in both games.

The player (or the dealer) will have a winning round against the dealer (or player) if he wins both components of the game, i.e., he must beat both the dealer's Twenty-One and Baccarat hands. If the player wins one hand against the dealer and loses the other then the player's bet is a push to the next round of play. If a player wins one hand and the other is a tie, then he has a winning round against the casino. If both hands result in ties, then the player's bet is a push to the next round of play. In the event of a push, the player involved has the choice of changing his bet (higher or lower) or removing the bet completely.

After the dealer evaluates his hands against the corresponding hands of each player, he settles any bets in the bank betting area 9 of each player station. That is, the dealer first settles any bets between each player and the bank. Then the dealer compares the hands of each player against other players when second bets have been made by one or more players in the player betting area 12 of each station. Only the first four cards dealt by the dealer can be used by each player when settling second bets. If, for example, all seven players participate in second bets against each other, and there is a tie between two of the highest hands, the two players holding those hands will split the wagers collected from the five losing players. In fact, the players are now playing against each other and the dealer acts as a broker for settling all bets among players. In return for this, it is conceivable that the casino would require a 5% commission on any second bets between players.

After all bets are settled between the bank and among players, the cards are collected and the game is continued as described above. As in conventional blackjack, if during distribution of the cards, the marker in the shoe shows that there may not be enough cards for all the components of the game to be played, the cards are simply reshuffled before proceeding with play.

The present invention provides a novel and unique gaming method and apparatus which allows more experienced players to increase their odds against the bank and at the same time provides the bank/casino more opportunities to gain revenues from each player more rapidly. As explained above, the present invention combines Twenty-One and Baccarat to allow each player to play each game simultaneously against the bank as well as second wagers against other players. The inventor believes that the present invention provides an exciting new parameter to casino play which has never yet been provided.

Although the present invention has been described above in detail, it is not limited to the specific embodiments described herein. Various modifications and additions may be made and will be apparent to those skilled in the art. For example, the present invention could be easily adapted for electronic play or as a home board game in the same manner that blackjack and other popular games have been adapted in the past. Accordingly, the invention should not be limited to the foregoing description but rather should be defined only by the following claims.

What is claimed is:

1. A method of playing a mixture of Twenty-One and Baccarat wherein a player simultaneously plays against a dealer and other players, comprising:

providing a playing station for each player, said playing station comprising:

(i) a card playing area having a first horizontal row of two boxes, a second horizontal row of two boxes, and a third box positioned to one side of the first and second horizontal rows of boxes;

(ii) a casino betting area positioned to one side of the third box;

(iii) an extra card betting area positioned adjacent the casino betting area; and (iv) a player betting area positioned to the other side of the card playing area and having two positions corresponding to the first and second horizontal rows of boxes in the card playing area;

each player making a first bet in the casino betting area of their playing station;

the dealer dealing a first card face-up to each player and one card face-down to the dealer;

at least one player making a second bet in at least one of the two positions in the player betting area of his playing station;

the dealer dealing three additional cards face-down to each player and the dealer;

each player assembling two cards dealt from the dealer face down in each of the first and second horizontal rows of boxes;

the dealer assembling his four dealt cards in a dealer playing station face down in a manner corresponding to each player;

at least one player making a third bet in the extra card betting area of his playing station;

the dealer dealing a fifth card to and placing that card face down in the third box of the playing station of said at least one player making a third bet;

the dealer comparing the cards assembled in each row of boxes in his playing area to cards assembled in corresponding rows of boxes in each player playing station, wherein the card in said third box is appropriately summed with the cards in each of the first and second rows of boxes, and collecting or paying said first and third bets in the casino and extra card betting areas of each playing station; and the dealer comparing cards assembled in each row of boxes in each player playing station, wherein the card in said third box is appropriately summed with the cards in each of the first and second rows of boxes, and settling said second bets between players in each player betting area of each playing station.

2. The method of claim 1, wherein the dealer also takes a fifth card, places that card face down in the third box of the dealer playing station, and that card is combined with the cards in each of the first and second rows of boxes in the dealer playing station.

3. The method of claim 1, wherein each second bet placed by any player in his player betting area corresponds to at least 50% and no more than 100% of the amount of said first bet of that player.

4. The method of claim 1, wherein the third bet equals 50% the first bet made by said at least one player.

5. The method of claim 1, wherein cards are dealt to the players and dealer in a single fashion and in a clockwise manner.

6. The method of claim 1, wherein at least two fifty-two card decks are used by the dealer.

7. The method of claim 5, wherein up to seven players are participating at one time.

8. The method of claim 1, wherein the first row of two boxes is used to play Twenty-One and the second row of two boxes is used to play Baccarat.

9. The method of claim 1, wherein the player receiving the highest ranking first card from the dealer is the first player to make a second bet in the player betting area of his playing station.

10. The method of claim 9, wherein at least one additional player matches the second bet placed by the highest ranking cardholder, by placing a second bet in the player betting area of the player betting station of said at least one additional player.

11. A method of simultaneously playing Twenty-One and Baccarat wherein a player plays against a dealer and other players, comprising:

each player making a first bet against the dealer to be eligible to play one hand in each of the two games;

the dealer dealing a first card face-up to each player and one card face-down to the dealer;

at least one player making second bets against other players based on the first card received from the dealer;

the dealer dealing three additional cards face-down to each of the players and to the dealer;

each player and the dealer assembling their dealt cards such that two cards are assembled for Twenty-One and two cards are assembled for Baccarat;

at least one player making a third bet;

the dealer dealing a fifth card to said at least one player making a third bet;

the dealer comparing each of his assembled groups of cards to corresponding groups of cards of each player, wherein the fifth card is appropriately summed with each two sets of cards for Twenty-One and Baccarat, paying each player having a winning round compared to the corresponding hand of the dealer, and collecting bets from each player having a losing round compared to the corresponding hand of the dealer; and the dealer comparing the assembled groups of cards of each player, wherein the fifth card is not summed with each two sets of cards for Twenty-One and Baccarat, to settle any second bets made among the players.

12. The method of claim 11, wherein the dealer also takes a fifth card and that card is appropriately summed with his two sets of assembled cards.

13. The method of claim 12, wherein a winning round consists of wins in both the Twenty-One and Baccarat hands or a win is one of the Twenty-One and Baccarat hands and a tie is the other of the Twenty-One and Baccarat hands.

14. An apparatus for playing a mixture of Twenty-One and Baccarat wherein a player simultaneously plays against a dealer and other players, said apparatus comprising:

a table having an upper playing surface;

a dealer playing station at a first position on said playing surface, said dealer playing station comprising two horizontal rows of two boxes and a third box positioned to one side of the two rows of boxes; and a plurality of player playing stations at spaced positions on the playing surface and opposed to said dealer playing station, each of said player playing stations comprising two horizontal rows of two boxes arranged in the same manner as in the dealer playing station, a third box positioned to one side of the two horizontal rows of boxes, a casino betting area positioned to one side of the third box, an extra card betting area positioned adjacent the casino betting area, and a player betting area positioned to the other side of the horizontal rows of boxes and having two positions corresponding to the two horizontal rows of boxes.

15. The apparatus of claim 14, wherein the playing surface is formed substantially in the shape of a semicircle having a substantially linear side along the diameter of the semicircle and a curved side along the circumference of the semicircle.

16. The apparatus of claim 14, wherein the dealer playing station is arranged substantially midway along the diameter of the semicircular playing surface and the player playing stations are arranged along the circumference of the semicircular playing surface and spaced an equal distance apart.

17. A method of simultaneously playing Twenty-One and Baccarat wherein players play against the dealer and other players, comprising the steps of:

a) each player making a first wager to participate against the dealer simultaneously in a combination of Twenty-One and Baccarat;

b) the dealer dealing one card face up to each player and one card face down to the dealer;

c) the dealer dealing three additional cards face down to each player and to the dealer;

d) each player and the dealer organizing his cards in two sets: two cards for Twenty-One and two cards for Baccarat, and arranging the sets of cards face down;

e) at least one player making an additional bet against the casino to receive a fifth card from the dealer;

f) the dealer turning over the sets of cards of each player and the dealer; and g) the dealer settling wagers between the bank and each player, wherein the fifth card is appropriately summed with each set of cards for Twenty-One and Baccarat.

18. The method of claim 17, wherein the dealer also takes a fifth card and that card is appropriately summed with each set of cards for Twenty-One and Baccarat.

* * * * *